United States Patent [19]

Jacobs et al.

[11] Patent Number: 4,928,080

[45] Date of Patent: May 22, 1990

[54] MOLDED CASE CIRCUIT BREAKER LINE TERMINAL PLUG

[75] Inventors: Linda Y. Jacobs, Barkhamsted; Joseph M. Palmieri, Southington; James I. Smith, Avon, all of Conn.

[73] Assignee: General Electric Company, New York, N.Y.

[21] Appl. No.: 370,947

[22] Filed: Jun. 23, 1989

[51] Int. Cl.[5] ..... H01H 9/02

[52] U.S. Cl. ..... 335/202; 335/42

[58] Field of Search ..... 335/6, 8≅10, 335/35, 42, 45, 132, 202; 200/293, 304, 305

[56] References Cited

U.S. PATENT DOCUMENTS

| | | | |
|---|---|---|---|
| 4,037,184 | 7/1977 | Kempisty, Jr. et al. | 335/6 |
| 4,511,772 | 4/1985 | Link et al. | 200/147 R |
| 4,589,052 | 5/1986 | Dougherty | 361/94 |
| 4,639,564 | 1/1987 | Grunert et al. | 200/144 |
| 4,728,914 | 3/1988 | Morris et al. | 335/6 |
| 4,754,247 | 6/1988 | Raymont et al. | 335/202 |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A combined arc gas controller-line terminal plug is used within molded case circuit breaker covers to direct the flow of arc gases that occur during intense overcurrent circuit interruption. The plugs simultaneously prevent access to the line terminal lugs while controlling the egress of the arc gases. Moreover, the plugs are removable for connection with and disconnection from an associated electrical power distribution system.

17 Claims, 5 Drawing Sheets

MOLDED CASE CIRCUIT BREAKER LINE TERMINAL PLUG

BACKGROUND OF THE INVENTION

The use of removable plugs to prevent access to the line terminals of industrial-rated circuit breakers is described in U.S. Pat. No. 4,754,247 wherein the removable plugs are inserted in the circuit breaker cover within the access holes to the line terminals. The plugs are removed when connecting the circuit breakers within an electrical distribution circuit and are later replaced to prevent accidental contact with the energized line terminals.

When a compact current limiting circuit breaker, such as that described within U.S. patent application Ser. No. 344,936 filed Apr. 28, 1989 and entitled "Compact Current Limiting Circuit Breaker" is used within an industrial power distribution circuit, intense arc gases are generated during overcurrent interruption. This Application should be reviewed for its teachings of an arc chute arrangement for rapidly de-ionizing and extinguishing an intense arc. During the existence of the arc, high temperature gases are generated which must exit from the line side of the circuit breaker enclosure in order to prevent the circuit breaker enclosure from becoming over-stressed. During the arc occurrence, some means must usually be employed to prevent the ionized gases from contacting the associated grounded enclosure to thereby prevent the occurrence of a so-called "line-to-ground" fault. Further means must be employed to prevent the arc gases exiting from one line terminal compartment from contacting a line terminal connector within an adjacent line terminal compartment to prevent a so-called "phase-to-phase" fault.

U.S. Pat. No. 4,639,564 describes one such means integrally-formed within the circuit breaker cover to prevent the arc gases from causing electrical breakdown between a terminal and a proximate conductor.

It would be advantageous, for manufacturing and operating purposes, to provide controlled egress of the arc gases during circuit interruption while simultaneously preventing access to the line terminals when the circuit breaker is installed within the associated industrial power distribution circuit.

This invention accordingly provides a combined means for preventing access to the line terminals while simultaneously controlling the egress of arc gases from the circuit breaker enclosure.

SUMMARY OF THE INVENTION

Integrally-formed line terminal plugs that simultaneously control arc gas flow are factory installed within the line lug access openings in a circuit breaker cover. The terminal plugs cooperate with keyways integrally-formed within the circuit breaker cover to fixedly hold the plugs within the line terminal access openings. The plugs are removed in the field to access the line terminals and are replaced thereafter for preventing access to the terminals while at the same time controlling the egress of arc gases from the circuit breaker enclosure.

DESCRIPTION OF THE PREFERRED EMBODIMENT

Figure 1:
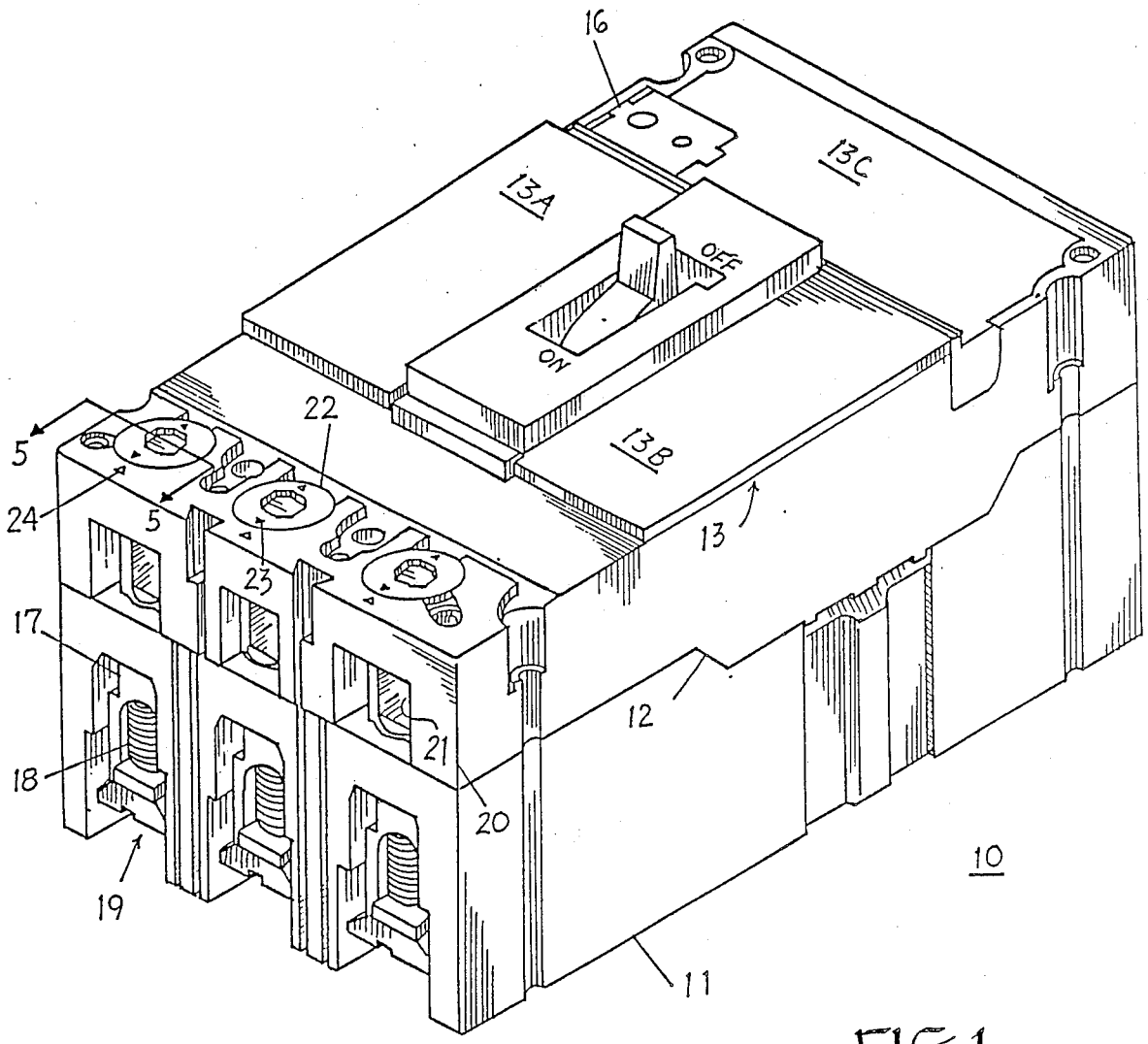
FIG. 1 is a top perspective view of a circuit breaker employing the line terminal plugs in accordance with the invention.

A compact circuit interrupter 10 of the type controlled by an electronic trip unit is shown in FIG. 1 to consist of a molded plastic case 11 to which a molded plastic cover 12 is attached. An accessory cover 13 allows access to an accessory such as an auxiliary switch, or bell alarm (not shown) under accessory door 13A while a separate accessory door 13B allows access to an electromagnetic trip actuator, also not shown. An electronic trip unit, such as that described in U.S. Pat. No. 4,589,052, which Patent is incorporated herein for reference purposes, is located under the accessory door 13C. An externally accessible rating plug 16, such as described within U.S. Pat. No. 4,728,914, is inserted within the accessory cover and electrically connects with the electronic trip unit. Electrical connection with the electrical power distribution circuit is made by means of the line terminal connectors consisting of the line lugs 17 and line terminal screws 18 which are located within the line terminal compartments 19. To prevent external access to the line terminal connectors, a line terminal plug 22 is inserted through the top of each separate line lug compartment. When the line terminal plugs are arranged such that the indicia 23 on the plugs aligns with the corresponding indicia 24 on the end 20 of the circuit breaker cover, the arc gases that are generated within the circuit breaker case readily exit through the slots 21 formed within the end of the cover.

Figure 2:
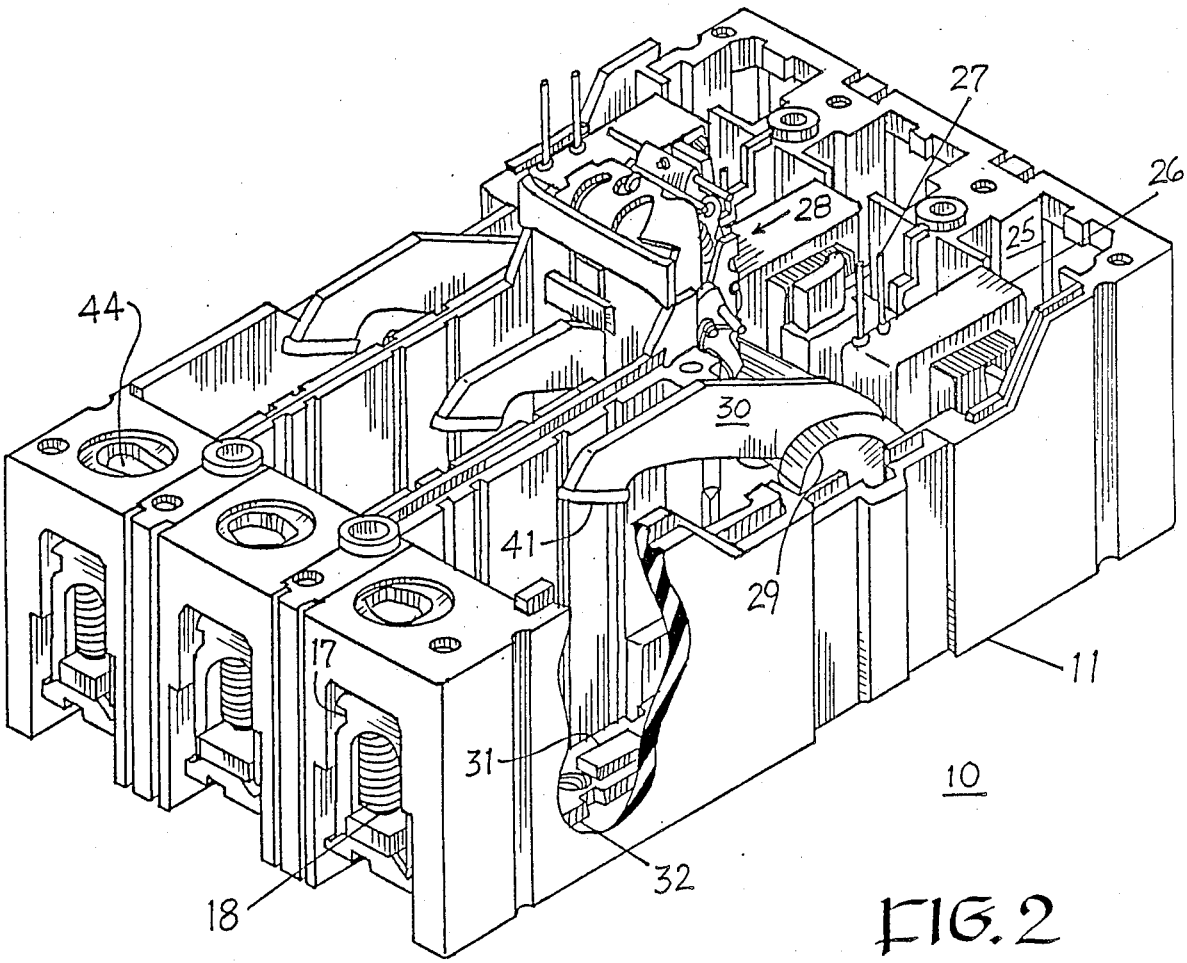
FIG. 2 is a top perspective view of the circuit breaker case depicted in FIG. 1.

Referring now to FIG. 2, the circuit breaker case 11 is exposed to show the current path provided from the load lug compartment 25 which contains the load terminal connectors (not shown) that connect with an industrial load and with the current sensing transformers 26 for sensing the magnitude of the circuit current. The current transformers electrically connect with the circuit breaker electronic trip unit contained within the circuit breaker cover by means of the pin connectors 27. The circuit current transfers through the current transformers to the movable contact arms 30 which are rotatably mounted on the circuit breaker crossbar assembly 29. The movable contacts 41 attached to the movable contact arms separately connect with the fixed contacts 31 that are attached to the line terminal straps 32. The line terminal strap directly connect with the line terminal lugs 17 and line terminal screws 18. The ON-OFF condition of the circuit breaker contacts is controlled by the operating mechanism 28 which is in turn controlled by the electronic trip unit. When a predetermined current exists for a predetermined period of time, the operating mechanism drives the crossbar and movable contact arms to the open position indicated in FIG. 2 to thereby interrupt the circuit current by rapidly separating the movable and fixed contacts. When such contacts are separated under overcurrent conditions, an arc is generated therebetween which consists of highly ionized mobile arc gases. The line terminal lugs 17 are isolated from the arc generated within the case by means of a barrier wall (not shown) such that the arc gases exit by means of the egress slots 21 formed within the end 20 of the circuit breaker cover 12 shown in FIG. 3. Keyway slots 35 formed through the circuit breaker cover communicate with the egress slots and the access openings 44 (FIG. 2) to provide access to the line terminal screws. The line terminal plugs 22 are inserted in the keyway slots to prevent inadvertent contact with the line terminal screws and lugs when connected within the industrial power distribution system. The line terminal plugs each consist of a cylindrical top 36 which is joined to a bottom planar bight portion 39 by means of depending sidepieces 37, 38. An opening 43 is defined between the sidepieces for directing the arc gases through the exit slots 21. A peripheral groove 42 formed between the cylindrical top and the sidepieces allows the line terminal plug to be rotated within the keyway slot to cause the directional indicia 23 on the plug to coincide with the directional indicia 24 provided on the surface 33 of the end of the circuit breaker cover. A perimetric recess 34 formed around the keyway slot allows the top surface 45 of the line terminal plug top to be flush with the surface of the circuit breaker cover when the line terminal plug is inserted within the keyway slot. To insure the correct orientation of the line terminal plug with respect to the directional indicia 23, 24, a detent 46 is provided on the top of side-piece 37 which cooperates with a corresponding slot 47 formed within the cover under the perimetric recess 34. When the indicia align, the detent is trapped within the slot and indicates to the operator that the correct position is achieved.

Figure 3:
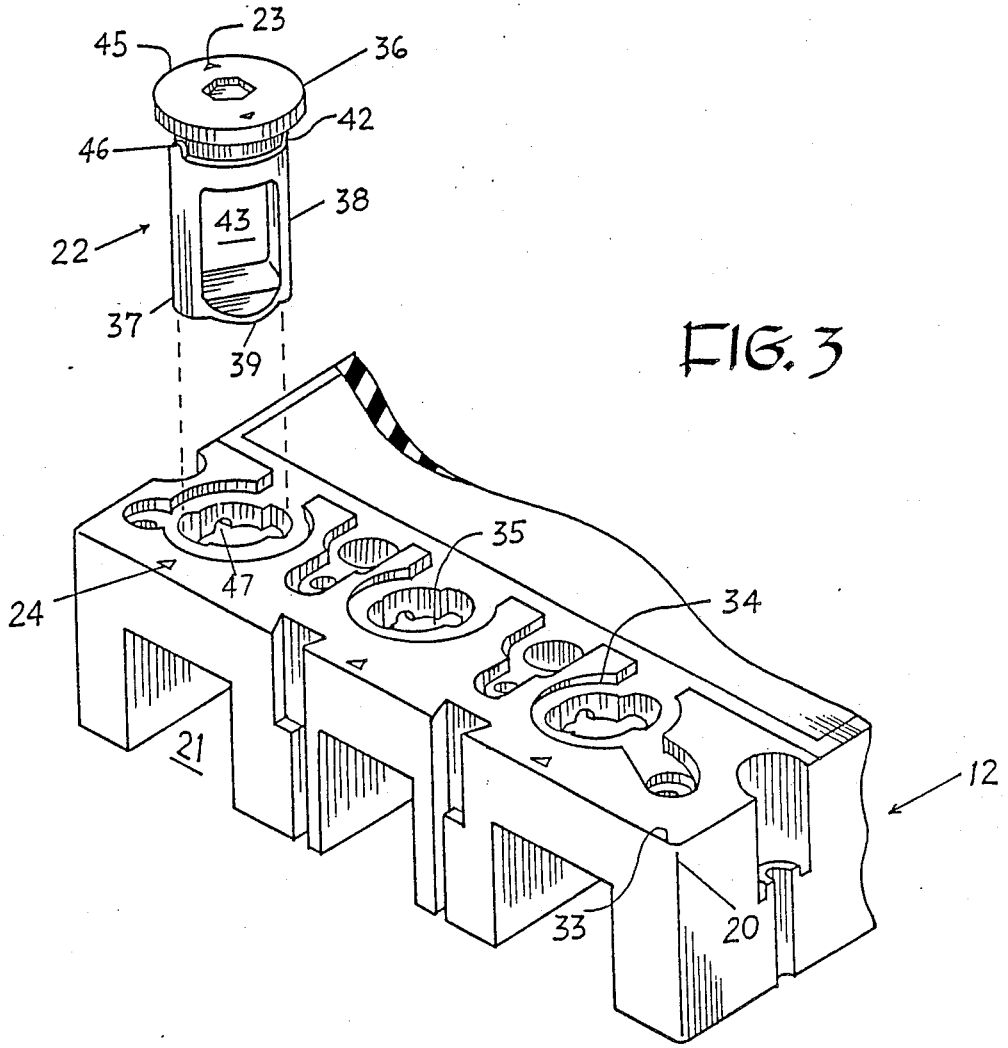
FIG. 3 is an enlarged top prospective view of the end of the circuit breaker cover depicted in FIG. 1 prior to the insertion of the line terminal plug.
Figure 4A:
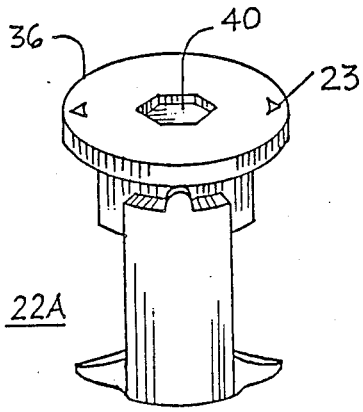
FIGS. 4A–4C are top perspective views of the line terminal plugs of FIG. 3 in different stages of rotation.
Figure 4B:
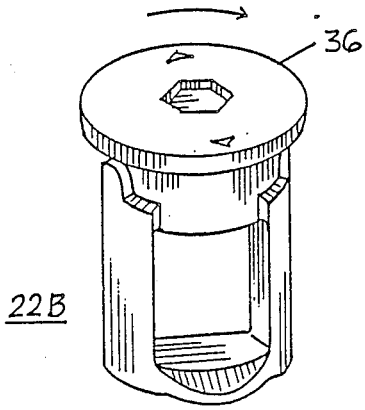
Figure 4C:
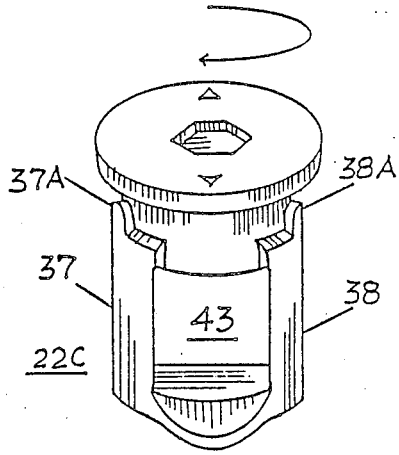

FIGS. 4A–4C depict the orientation of the line terminal opening 43 as the line terminal plug 22A–22C is rotated within the keyway slot. When the line terminal plug is first inserted within the keyway slot, the sidepieces extend downward within the slot until the top of the line terminal plug bottoms against the perimetric recess 34 (FIG. 3). At this time, the line terminal plug indicia 23 faces the direction depicted in FIG. 4A. By inserting a hex wrench within the hexagonal-shaped recess 40 formed within the cylindrical plug top 36 and rotating in a clockwise direction, the line terminal plug assumes the position depicted at 22B in FIG. 4B. Continued rotation in the clockwise direction traps the shoulders 37A, 38A formed on the top of the side-pieces 37, 38 under the perimetric recess 34 thereby preventing the line terminal plug from being removed until the line terminal plug is rotated in the reverse direction. The final operating position is indicated at 22C in FIG. 4C such that the opening 43 is in registry with the exit slots 21 shown earlier in FIG. 3.

Figure 5:
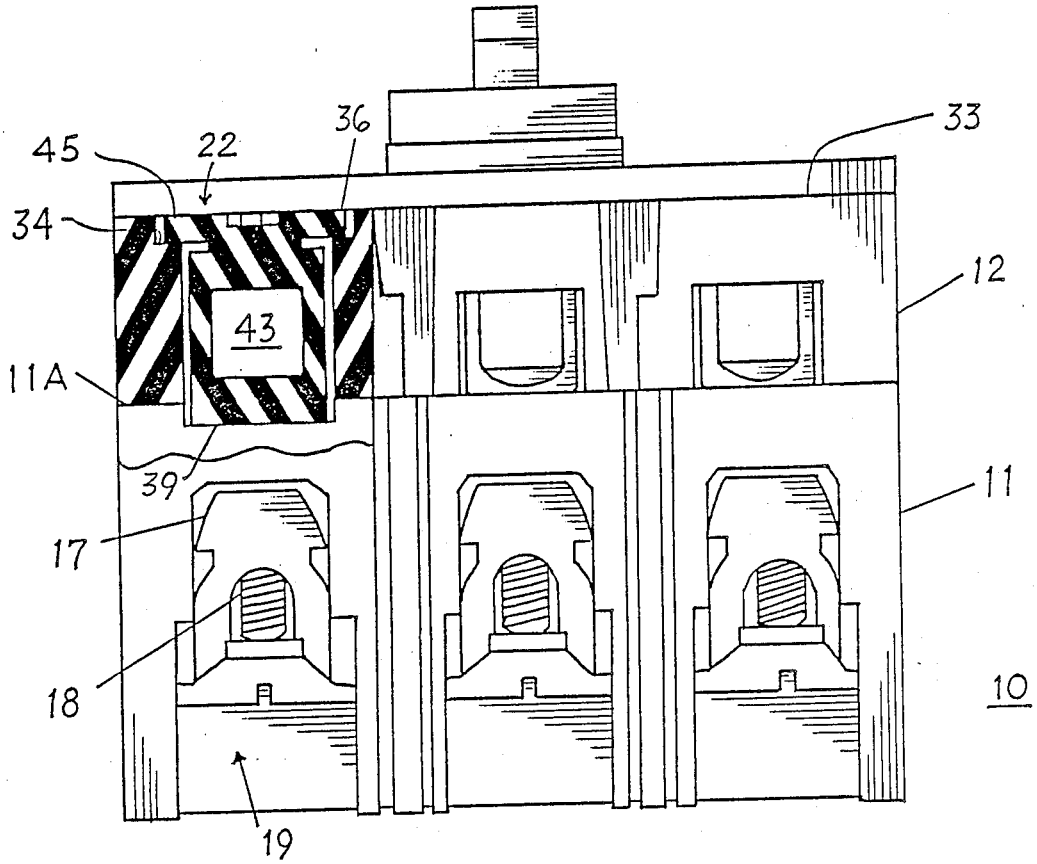
FIG. 5 is an end view in partial section of the circuit breaker shown in FIG. 1.

The orientation of the opening 43 within the circuit breaker cover is best seen by referring to FIG. 5 wherein the circuit breaker 10 is arranged with the ends of the circuit breaker case 11 and circuit breaker cover 12 facing outwards from the page. The top surface 33 of the top 36 of the line terminal plug 22 is flush with the top surface 33 of the circuit breaker cover and the bottom surface of the line terminal plug top is supported by the perimetric recess 34. The bottom bight portion 39 sits on the top 11A of the circuit breaker cover to seal the line lug compartment 19 described earlier thereby preventing the arc gases from contacting the associated line lug 17 and line terminal screw 18.

Figure 6A:
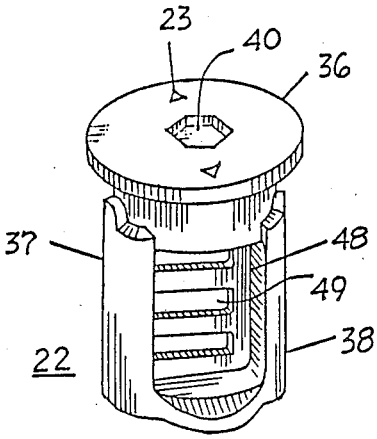
FIG. 6A–6F are top perspective views of alternate embodiments of the line terminal plug of FIGS. 4A–4C.
Figure 6B:
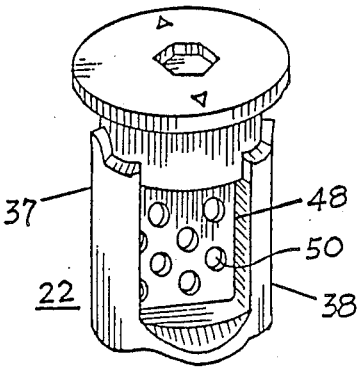
Figure 6C:
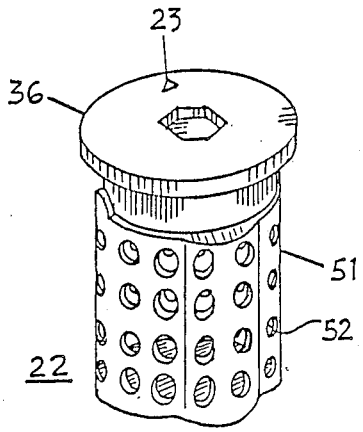
Figure 6D:
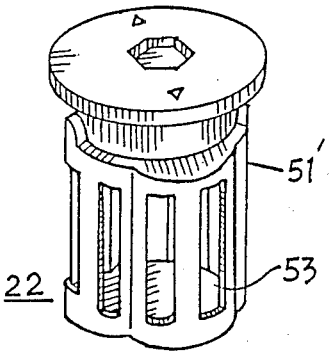
Figure 6E:
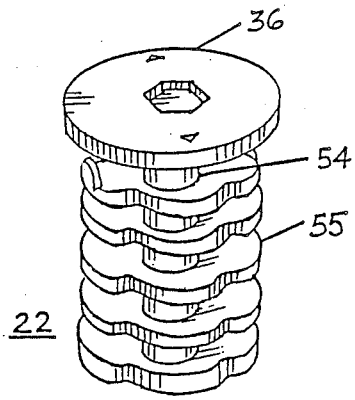
Figure 6F:
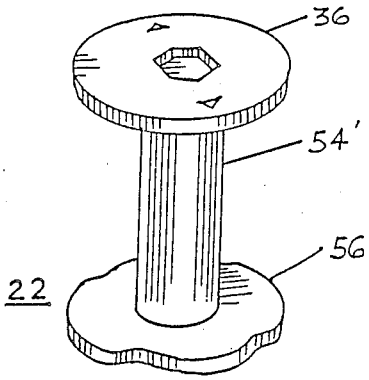

Other configurations of the terminal plugs 22 are depicted in FIGS. 6A–6F where controlled venting of the arc gas is selectively achieved. Directional venting is achieved by means of the line plugs depicted in FIGS. 6A and 6B wherein the configuration is similar to that depicted in FIG. 3 such that the cylindrical top 36 includes the hex-shaped recess 40 and indicia 23. The sidepieces 37, 38 are joined by a center wall 48 which, in the embodiment depicted in FIG. 6A, includes a plurality of horizontal slots 49 and, in the embodiment depicted in FIG. 6B, a plurality of apertures 50. The line plugs depicted in FIGS. 6C–6F also include the indicia 23 to insure that the line plug is arranged correctly within the keyway slot 35 (FIG. 3). The line plug shown in FIG. 6C includes a cylinder 51 integrally-formed with the cylindrical top 36 and includes a plurality of apertures 52 such that an equivalent number of apertures are exposed regardless of the orientation of the line plugs with respect to the slots 21 formed in the end of the cover 12, depicted earlier in FIG. 1. The cylinder has a keyway-shaped configuration in order to trap the line plugs under the keyway slot as described earlier. The configuration depicted in FIG. 6D includes a similar cylinder 51' with a plurality of vertical slots 53 such that the arc gases will vent out from the cover regardless of the orientation of the line plug within the keyway slot. The configuration depicted in FIG. 6E consists of a central post 54 integrally-formed with the cylindrical top 36 and includes a plurality of key-shaped discs 55 formed with the central post. This configuration allows ample venting of the arc gases through the slots in the cover independent of the orientation of the line plug within the keyway slot. The number of such keyway-shaped discs along with the diameter of the central post 54 determine the space available for venting of the arc gases. A simplified embodiment of the line plug 22 is depicted in FIG. 6F wherein a cylindrical post 54' is integrally-formed with the cover 36 and includes a keyway-shaped bottom 56 that allows the line plug to pass through and be retained within the keyway slot. The amount of gas venting is simply determined by the diameter of the cylindrical post and is constant regardless of the orientation of the line plug.

A multi-functional line terminal plug has herein been described. The line terminal plugs are arranged for insertion within the access openings to the circuit breaker line terminal connectors to prevent inadvertent access thereto, while facilitating the egress of the arc gases from the circuit breaker case.

Having thus described our invention, what we claim as new and desire to secure by Letters Patent is:

1. A molded case circuit breaker comprising:

a circuit breaker case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings; and line plugs removably arranged within said access openings thereby preventing access to said line terminal connectors while allowing egress of said arc gases, said plugs comprising a cylindrical top having tool-receiving recess means formed in a top surface thereof, said plugs further comprising a planar body member having a plurality of longitudinal slots formed therein.

2. A molded case circuit breaker comprising:

a circuit breaker case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings; and line plugs removably arranged within said access openings thereby preventing access to said line terminal connectors while allowing egress of said arc gases, said plugs comprising a cylindrical top having tool-receiving recess means formed in a top surface thereof, said plugs further comprising a planar body member having a plurality of apertures formed therein.

3. A molded case circuit breaker comprising:

a circuit breaker case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings; and line plugs removably arranged within said access openings thereby preventing access to said line terminal connectors while allowing egress of said arc gases, said plugs comprising a cylindrical top having tool-receiving recess means formed in a top surface thereof, said plugs further comprising a keyway-shaped body member having vertical slots formed therein.

4. A molded case circuit breaker comprising:

a circuit breaker case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings; and line plugs removably arranged within said access openings thereby preventing access to said line terminal connectors while allowing egress of said arc gases, said plugs comprising a cylindrical top having tool-receiving recess means formed in a top surface thereof, said plugs further comprising a keyway-shaped body member having a plurality of horizontal slots formed therein.

5. A molded case circuit breaker comprising:

a circuit breaker case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings; and line plugs removably arranged within said access openings thereby preventing access to said line terminal connectors while allowing egress of said arc gases, said plugs comprising a cylindrical top having tool-receiving recess means formed in a top surface thereof, said plugs further comprising a keyway-shaped body member having a plurality of apertures formed therein.

6. A molded case circuit breaker comprising:

a circuit breaker case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings; and line plugs removably arranged within said access openings thereby preventing access to said line terminal connectors while allowing egress of said arc gases, said plugs comprising a cylindrical top having tool-receiving recess means formed in a top surface thereof, said plugs further comprising a central post member depending from said top, said post including a plurality of key-shaped discs supported thereon.

7. A molded case circuit breaker comprising:

a circuit breaker case and cover;

a pair of separable contacts arranged within said case under control of an operating mechanism to interrupt circuit current upon occurrence of an overcurrent condition through said contacts;

a plurality of line terminal connectors arranged within a corresponding plurality of line terminal compartments at one end of said circuit breaker case;

a corresponding plurality of line terminal access openings formed within said circuit breaker cover in registry with said line terminal connectors;

a corresponding plurality of arc gas egress slots formed within said circuit breaker case perpendicular to said access openings; and line plugs removably arranged within said access openings thereby preventing access to said line terminal connectors while allowing egress of said arc gases, said plugs comprising a cylindrical top having tool-receiving recess means formed in a top surface thereof, said plugs further comprising a central post depending from and integrally-formed with said top, said post having a diameter sized to determine gas flow through said plugs.

8. The molded case circuit breaker of claim 1, 2, 3 or 4 wherein said access openings comprise shaped keyways having first and second widths, said first width being greater than said second width.

9. The circuit breaker of claim 1, 2, 3 or 4 wherein said plugs further include a pair of sidepieces depending downward from said top.

10. The circuit breaker of claim 1, 2, 3 or 4 including a perimetric slot integrally-formed under said top, intermediate said sidepieces.

11. The circuit breaker of claim 1, 2, 3 or 4 wherein each of said sidepieces defines a shoulder formed on a top part thereof subjacent said perimetric slot.

12. The circuit breaker of claim 1, 2, 3 or 4 wherein said sidepieces are sized to pass through said first width and not pass through said second width, whereby said plug is unremovable from said access slot when rotated to position said sidepieces under said second width.

13. The circuit breaker of claim 1, 2, 3 or 4 further including first directional indicia on a top surface of said plug.

14. The circuit breaker of claim 1, 2, 3 or 4 including second directional indicia on a top surface of said circuit breaker cover proximate said access slot, said first and second indicia being oriented for rotating said sidepieces under said second width in one direction and for rotating said sidepieces out from under said second width in an opposite direction.

15. The circuit breaker of claim 1, 2, 3 or 4 wherein said circuit breaker cover top surface includes a peripheral recess formed around said access slot, said peripheral recess having a depth arranged to receive cylindrical top whereby said top surface of said plug is flush with said top surface of said circuit breaker cover when said plug is inserted within said access slot.

16. The circuit breaker of claim 1, 2, 3 or 4 wherein said line terminal connectors include a line terminal screw having a hex-shaped recess on one end.

17. The circuit breaker of claim 1, 2, 3 or 4 wherein said tool-receiving recess comprise a hex-shape whereby a common tool is received within said hex-shaped recess on said line terminal screw and said tool-receiving recess on said plug.

* * * * *